US005233774A

United States Patent [19]

Leibowitz

[11] Patent Number: 5,233,774

[45] Date of Patent: Aug. 10, 1993

[54] BATON GUN

[76] Inventor: Joel Leibowitz, 26 W. 87th St., New York, N.Y. 10024

[21] Appl. No.: 799,774

[22] Filed: Nov. 27, 1991

Related U.S. Application Data

[63] Continuation-in-part of Ser. No. 639,682, Jan. 10, 1991, abandoned.

[51] Int. Cl.[5] ..... F41C 9/02

[52] U.S. Cl. ..... 42/1.09; 42/1.06; 42/105

[58] Field of Search ..... 42/1.09, 1.08, 1.06, 42/1.16, 105

[56] References Cited

U.S. PATENT DOCUMENTS

| | | | |
|---|---|---|---|
| 752,893 | 2/1904 | Evensen | 42/1.16 |
| 1,160,343 | 11/1915 | Tomaszewski | 42/1.16 |
| 1,598,784 | 9/1926 | Rae et al. | 42/1.16 |
| 1,994,295 | 3/1935 | Williams, Jr. | 42/1.08 |
| 2,050,861 | 8/1936 | Rolston | 42/1.16 |
| 2,073,128 | 3/1937 | Wadsworth | 42/1.08 |
| 2,195,711 | 4/1940 | Hutchison | 42/1.16 |
| 2,634,535 | 4/1953 | Borders | 42/1.16 |
| 3,728,809 | 4/1973 | Mulich et al. | 42/1.16 |

*Primary Examiner*—David H. Brown

[57] ABSTRACT

A projectile launching baton is provided which includes a hollow barrel, a handle disengageably connected to the barrel, and a projectile held in a mouth of the barrel. An outer wall of the barrel is formed with a substance such as a polycarbonate or a rubber. An interior wall of the barrel may be formed of steel. Within the handle is located a mechanism for causing discharge of the projectile from the barrel. An alternating series of recoil prevention elements are lodged in the handle adjacent the barrel. These elements are preferably alternating rings of lead and air-filled flexible-walled pillows.

34 Claims, 4 Drawing Sheets

2
4
2
2
42

32
33
20
34
28
19
27
A
23
21
22
D
61
N
62
64
18
17
13
16
4
14
25
15
24
26
2
8
7
6
12
10

BATON GUN

This is a continuation-in-part of application Ser. No. 07/639,682 filed Jan. 10, 1991, now abandoned.

BACKGROUND OF THE INVENTION

1. Field of the Invention

The present invention is concerned with a baton usable as a club but also capable of firing projectiles.

2. The Related Art

Nightsticks or billy clubs have long been used by police and the military for riot control and generally as a defensive weapon. When circumstances require greater force, an officer must resort to a gun. Under rapidly changing circumstances switching from one weapon to another may be a life-threatening few seconds. A single weapon combining the features of a club with those of a projectile launcher would minimize response time affording the officer a momentary edge. Additionally, a baton held launcher provides opportunity for teargas or other non-lethal projectile defense in contrast to the normally deadly force of a gun. A combination of club with non-lethal projectile force reduces the danger of unnecessary death, injury and liability.

A number of projectile launcher-baton weapons have been reported in the art. U.S. Pat. No. 752,893 (Evensen) describes a policeman's mace including a handle within which is a cartridge-discharging mechanism, a club portion, and a revolver-cylinder rotatedly mounted between club portion and handle. U.S. Pat. No. 1,598,784 (Rae et al) discloses a hand weapon including an incapacitating gas generator and an electrical means for setting-off the gas weapon activated by pressing a button on the handle.

U.S. Pat. No. 2,050,861 (Rolston) reports a teargas billy with a spring mechanism for activating discharge of a teargas cartridge. U.S. Pat. No. 2,195,711 (Hutchison) describes a hand weapon comprising a club provided with an axial barrel that includes a 3-chamber cartridge shell.

U.S. Pat. No. 3,728,809 (Mulich et al) describes a baton whose notable features include a plastic covering press fitted to the barrel functioning to provide sufficient mass to the launcher so as to reduce the amount of recoil to a comfortable level for the operator. The barrel interior walls are formed from a machined lightweight metal such as aluminum.

Although the art has steadily advanced in this field, there still remains room for considerable improvement. For instance, the weapons of the above-described patents still suffer from recoil after projectile discharge. Accurate aiming is thereby compromised. A means for eliminating or at least delaying recoil would be highly desirable.

Accordingly, it is a primary object of the present invention to provide a projectile launching baton that incorporates a means for eliminating or reducing recoil upon discharge.

Another object of the present invention is to provide a projectile launching baton with a firing and electrical discharge mechanism that can be activated by the same hand holding the baton.

A still further object of the present invention is to provide for multiple shell discharge from within the baton.

SUMMARY OF THE INVENTION

A projectile launching baton is provided comprising:

a hollow barrel having a first and second end opposite one another, the barrel possessing an outer wall formed from an organic polymeric substance;

a projectile positioned in a mouth of the barrel at the first end thereof; and a handle disengageably connected to the second end of the barrel, the handle comprising a chamber enclosing a means for initiating discharge of the projectile and at least one means for preventing recoil.

Several recoil preventative measures are structured into the baton. The at least one means of preventing recoil in the handle is an insert formed of a substance selected from the group consisting of lead, felt, cork, foam, water pillow, air pillow, gel pillow and combinations thereof. Preferably, the insert arrangement will be comprised of a series of alternating circular lead pieces and air inflated pillows. These inserts will be positioned near a first end of the handle which is adjacent the second end of the projectile containing barrel.

Where the abatement substance is inherently not a solid, there will be provided a suitable flexible walled enclosure to surround the abatement substance. Wall thicknesses may range anywhere from 1 to 100 mil, preferably from 2 to 10 mil, optimally about 5 mil in diameter. Film or foil polymeric web substances may be employed as the wall material. Illustrative polymeric webs are polyethylene, polypropylene, polyester (e.g. Mylar, ex DuPont), polyamide (e.g. nylon), and polyvinyl chloride. Within the flexible walled pillow there is placed the non-solid recoil abatement substance. Illustrative non-solid abatement substances are water and shatterable gels such as gels formed from gelatin and water. Gases may also be employed as the abatement substance. These gases may be selected from the group consisting of air, nitrogen, carbon dioxide and helium.

A still further recoil preventative measure is an organic polymeric material formed as an outer wall around the hollow barrel. Suitable for this purpose are substances such as polycarbonate (e.g. Lexan, ex General Electric Co.), polyester, nylon, polyacrylate (e.g. Lucite, ex Rohm & Haas) and rubber (e.g. Neoprene). These polymeric materials may also be reinforced with fibers of carbon, graphite, steel, Aramid ® and the like.

The barrel, interior to the polymeric substance, may be formed of steel, especially a light weight steel alloy. Radial diameter of the steel wall should range anywhere from 1/16 to ½ inch, optimally ⅛ inch gauge. Advantageously, the circumferential interior wall of the steel may be coated with a further layer of organic polymeric substance. Lexan or rubber are the substances of choice.

A cylindrical hollow lead sleeve may advantageously be inserted between the outer wall of polymeric material and the inner steel wall. Lateral shock and recoil forces are abated through the cylindrical lead sleeve feature. Optionally, a cylindrical lead sleeve may also be provided within at least part of the handle interior to its outer wall.

When utilizing a relatively large caliber charge or when a particular operator desires greater stability, a removeable recoil abatement substance of donut shape may be slipped around the outer wall of the baton. Preferably, the donut or ring will be in the form of an air bag mounted on a solid supporting base, e.g. polycarbonate. One or more attachment devices will be formed on the removeable donut so that it can be securely connected or readily detached from around the baton. Possible attachment devices may include snap-on buttons, screws, Velcro® or screw-eyelet arrangements. Most suitable as an attachment device is a hexagonal headed screw. On the baton handle there may be situated complementary means for cooperating with the attachment device on the donut, e.g. divets, for securing the latter to the handle.

A means for disengageably connecting the handle to the barrel is formed at respective ends thereof. Suitable for this purpose is a male-female screw assembly. Alternatively, the ends may be provided with radially disposed end opening bayonet slots cooperatively arranged to mate with projecting studs.

Adjacent a second end of the handle there is positioned the chamber enclosing the means for initiating discharge of the projectile. One or more batteries in tandem with a solenoid are the preferred means for initiating the discharge. Battery replacement can be accomplished by employing a disengageable cover at the second end of the handle. Cover and second end of the handle may be provided with complementary male-female threading as a simple disengagement-engagement system. A coil spring can serve to retain batteries rigidly within the handle and ensure proper electrical contact therewith.

Wall construction around the battery-solenoid area of the handle will differ from that of the recoil abatement insert area. The polymeric substance normally forming the outermost wall will here form an inner wall. A flexible walled fluid-filled sleeve will be positioned radially outwardly of the inner polymeric substance wall. Surrounding the fluid-filled sleeve and forming the outermost wall will be a rubber substance.

A series of apertures may be formed within the outer rubber wall portion of the handle. These apertures are an additional means for suppressing shock and recoil effects. Upon recoil, the fluid-filled sleeve can expand a short distance outwardly through the apertures to provide for even better recoil abatement. Particularly suitable fluids for this purpose are gelatin gels and air, with air being the fluid of choice.

Explosive means such as gun powder held within a blank shell will be removeably lodged at the second end of the barrel. Electrical terminals for conveying a spark to ignite the gun powder will be positioned adjacent the blank shell in an area within the second end of the barrel. Electrical contacts in the first end of the handle will communicate with the electrical spark generating terminals of the barrel. These contacts will also communicate with the solenoid and one or more batteries lodged near the second end of the handle.

Activation of the explosive is performed through a discharge button radially penetrating an outer surface of the handle. Accidental discharge is prevented by positioning the trigger button within a safety slide. Normally the button will be received in a latching portion of the slide. When ready for firing, the button must be slideably disengaged from the latching position and pushed into an activation position.

All other structural aspects of the handle may be formed from any of the organic polymeric substances hereinabove mentioned that form the outer wall around the barrel. Most preferred is polycarbonate because of its combined recoil preventative and strength properties.

Within the first end of the hollow barrel will be positioned a projectile such as a fleschette. Advantageously, this projectile will serve an additional function as a cover to the open first end of the hollow barrel. The projectile will be formed with a head and a body, preferably both being in a rounded shape. The head will preferably have a diameter greater than the diameter of the body. Portions of the head that protrude radially beyond the body diameter will serve to secure the projectile against a mouth of the hollow barrel, thereby supporting the projectile against the first end thereof. At least one protrusion will be formed along the wall of the body. These one or more protrusions will fittingly be pressable into corresponding recesses within an inner wall of the hollow barrel. Alternatively, the arrangement may be reversed so that the protrusions are formed on the inner wall of the hollow barrel while the recesses are formed on the outer wall of the body of the projectile.

An elastic or fluid-filled type of material is best utilized to form the head of the projectile. For instance, the head may be formed from a rubber such as 70 Duro Neoprene.

Alternatively, the head may be filled with pellets or powdered iron to inflict momentary shock on a target, achieving disorientation. Advantageously, the head should be disengageable from the body, preferably in a threaded screw arrangement. Thereby the projectile may be armed with different type heads depending upon the extent and nature of the force desired to be exerted.

The body is formed from polycarbonate. Conservation of materials and improved ballistic performance may be achieved by at least partially hollowing the body of the projectile. Overall, size of the projectile may vary from about 1 to about 10 inches, preferably between about 3 to about 6 inches, optimally about 4.5 inches in length.

Improved aerodynamic flight may be achieved by providing an air foil means such as fins projecting within the hollow body of the projectile. These air foils may be formed of the same or a different material than that of the body. Aluminum is a particularly preferred material for fashioning of the fins.

In a second embodiment of the invention, the barrel may be formed with a plurality of hollow inner barrels or tubes, for instance three hollow tubes. These tubes will each run the length of the barrel and have openings at the first end thereof. Each tube will receive its own separate projectile. Unlike most handgun barrels, it may be desired that none of the hollow tubes be revolvable so as to minimize parts and potential problems. Each hollow tube will be fitted with its own explosive shell for propelling the respective projectile.

For the multi-hollow tube embodiment, it is advantageous to lodge each of the explosive shells at the end of the respective hollow tubes and within the barrel portion of the baton. Each of the explosive shells will be lodged against a second end of the barrel adjacent an end of the handle. Each of the explosive shells may here also be in the form of a blank shell, preferably 45 or 50 caliber.

Activation of the multiple shells will again be through a discharge button held within a safety slide. The button will communicate with a solenoid which in turn will electrically detonate the respective shells.

Baton guns, as the foregoing description implies, can be employed as a weapon with potential for two-dimensional force. Under normal circumstances, the baton may be employed merely as a club. Under conditions where an officer may require greater force, the baton gun can serve as an intermediate weapon prior to utilization of a lethal force. The rubber or plastic projectile will then be used to stun and disorient any perpetrators, thereby providing the officer time when necessary to draw a pistol or revolver.

BRIEF DESCRIPTION OF THE DRAWING

The above and other objects, features and advantages of the present invention will become more readily apparent from the following description, reference being made to the accompanying drawing in which.

DETAILED DESCRIPTION

Figures 1, 2:
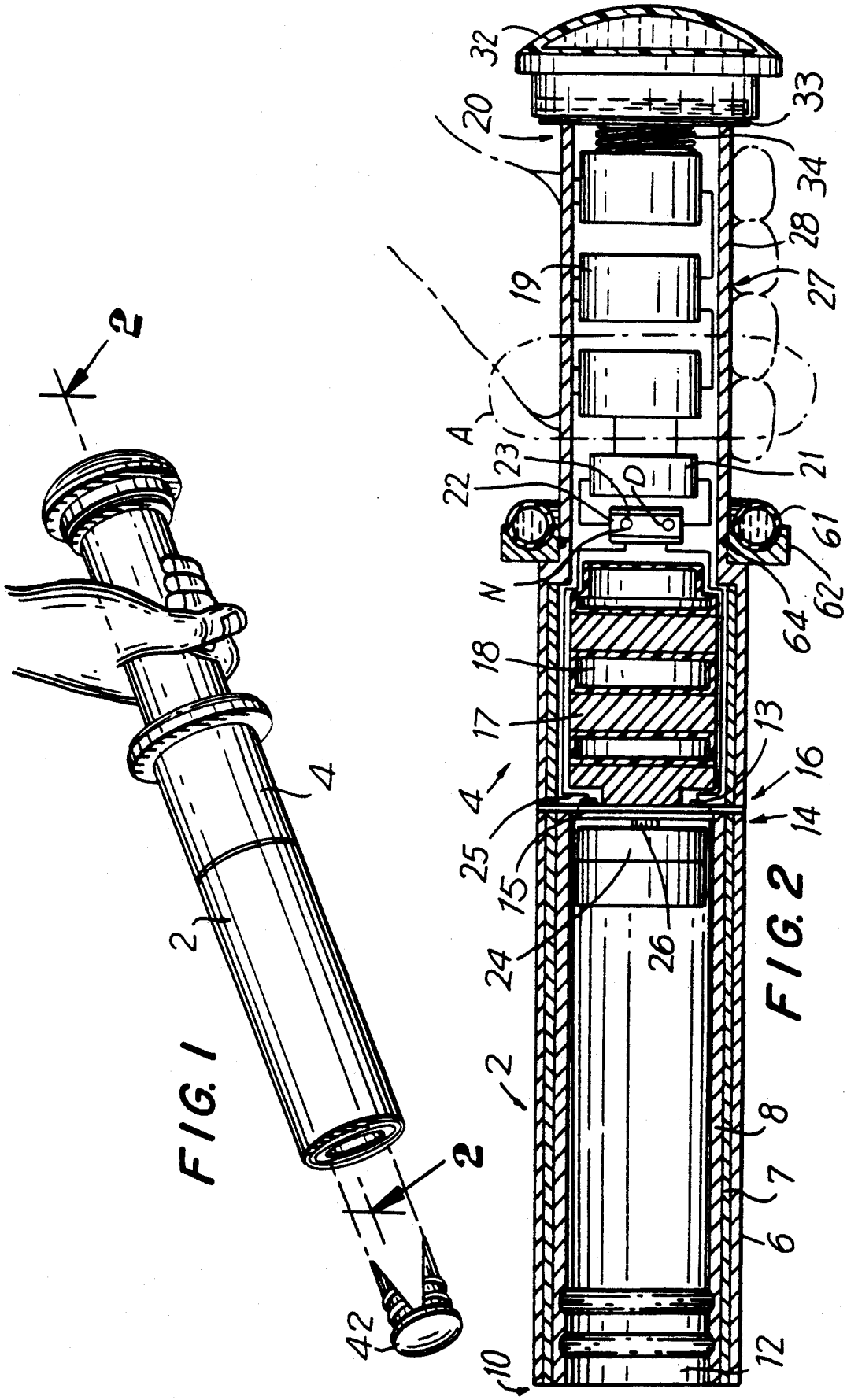
FIG. 1 is a perspective view of a first embodiment of the baton gun according to the invention.
FIG. 2 is a diagramatic cross-sectional view taken along a length of the first embodiment of the baton gun.

The projectile launching baton of the present invention in a first embodiment is illustrated in FIGS. 1 and 2. The baton includes a hollow barrel 2 and a handle 4. An organic polymeric substance, preferably polycarbonate, defines a circumferential outer wall 6 of barrel 2. Interior to wall 6 and congruently formed therewith is a steel wall 8. Cylindrical lead sleeve 7 for lateral recoil abatement is positioned between outer wall 6 and steel wall 8.

A first end 10 of barrel 2 has an open mouth 12. Opposite first end 10 is a second end 14 which includes a female screw connection 15.

Adjacent end 14 of the barrel is end 16 of handle 4. End 16 includes a male screw connector 13 disengageably connectable into connector 15.

Within handle 4 abutting end 16 are a series of alternating rings of lead 17 and air inflated pillows 18. These rings are a first-line preventative measure against recoil.

A series of batteries 19 are lodged within handle 4 at a second end 20. Batteries 19 are electrically connected to a solenoid 21 which in turn is electrically connected to a switch slide 22. Discharge button 23 is slideably lodged within switch slide 22 and radially positioned such that it penetrates through handle 4.

Switch slide 22 serves as a safety mechanism for securing button 23 against activation. Thus, when button 23 is in position N, there can be no activation of the explosive shell 24. Only when button 23 is slideably shifted to position D is there the possibility of igniting the explosive shell 24. Finger pressure on button 23 in position D activates a current through circuit 25 into electrical terminals 26 to set off the charge in shell 24.

Special wall construction is advantageously applied along an area 27 of the handle surrounding the battery-solenoid. See FIG. 7 and 10–13. An outer wall 28 formed of rubber (e.g. Neoprene) surrounds an intermediate air-filled flexible walled sleeve 29 which in turn surrounds an inner wall 30 formed of polycarbonate. A series of apertures 31 are formed within the outer wall 28. These apertures along a first arc of the handle may be relatively smaller and more numerous apertures 31*f* arranged for placement of the human finger portion of a grip. One or more relatively larger apertures 31*p* may be formed along a second arc of the handle for placement of the human palm. Upon receipt of a shock wave, the air-filled sleeve 29 can expand outwardly through apertures 31 thereby assisting dissipation of the shock force.

Cover 32 is threadably engaged over end 20 of handle 4. By engagement of the male-female thread arrangement 33 and through pressure of intervening coil spring 34, the batteries 19 are held firmly within the hollow of the handle and electrically communicate with one another and the solenoid 21. Removal of the batteries 19 is thereby also rendered simple merely through twisting-off cover 32 from end 20..

Figure 3:
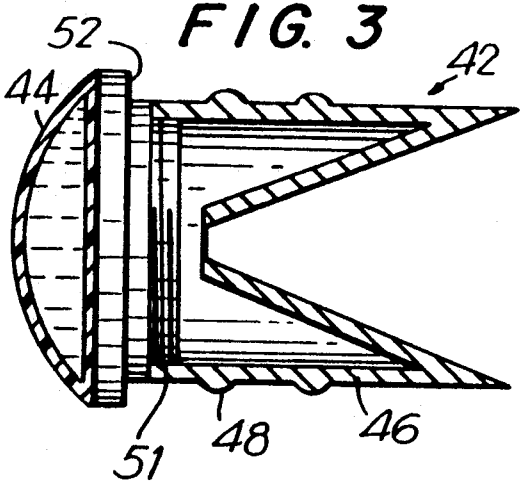
FIG. 3 is a diagramatic cross-sectional view taken along a length of a projectile suitable for emplacement within a mouth of a barrel of the baton gun of the invention.
Figure 7:
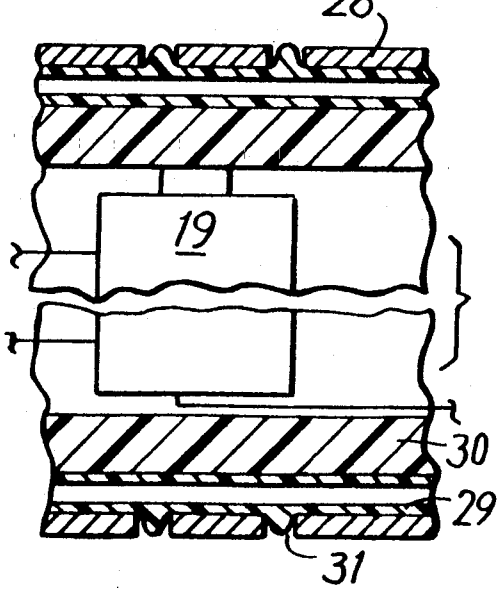
FIG. 7 is an employed view of area A of the handle of FIG. 2 with added feature of air and Neoprene sleeve surrounding handle.

FIG. 3 illustrates a projectile 42 which includes a head 44 and a body 46. Head 44 is formed from a Neoprene rubber while body 46 is formed from Lexan brand polycarbonate. A set of protrusions 48 project from body 46. These protrusions 48 fittingly can be lodged in congruent recesses 50 of the inner wall 6 of barrel 2. Head 44 has shoulders 52 which catch onto and are supported by first end 10 of barrel 2. Shoulders 52 prevent projectile 42 from slipping into barrel 2 and also serve to seal the barrel against contamination. Head 44 can readily be replaced through disengagement with threaded coupling 51.

Figure 4:
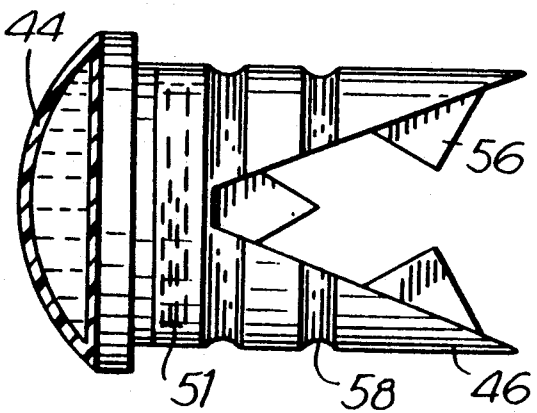
FIG. 4 is a view similar to FIG. 3 but including an illustration of air foils and recesses instead of protrusions on the body wall.
Figure 5:
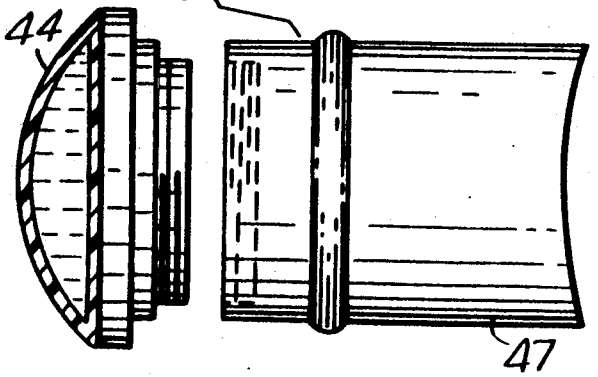
FIG. 5 is a view similar to FIG. 3 but illustrating the removeable head and a body shape for achieving greater velocity.

For purposes of reducing weight and thereby improving ballistic characteristics, projectile 42 is formed with a partial hollow 54. Additional aerodynamic improvements may be obtainable through use of air foil means such as fins 56 as illustrated in FIG. 4. Where a high velocity is sought, the projectile will have a less cut-out body 47 as seen in FIG. 5. Additionally illustrated in the projectile of FIG. 3 are projectile recesses 58 formed around the periphery of body 46. Recesses 58 would then congruently mate with protrusions (not shown) of inner steel wall 8 of barrel 2.

Figure 6:
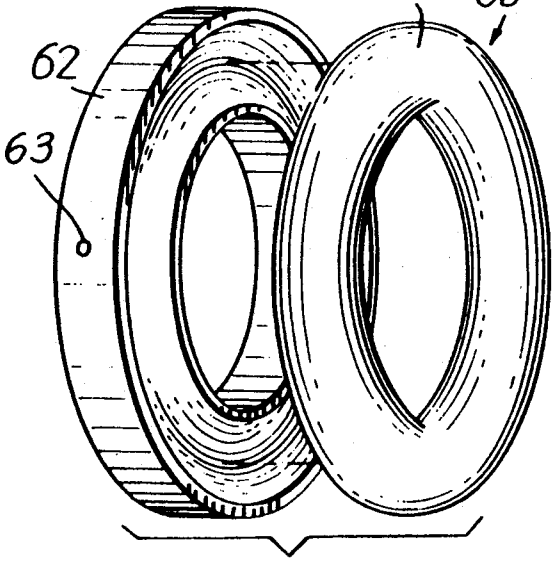
FIG. 6 is a plan view of a slip-on recoil abatement substance donut ring.

FIG. 6 illustrates an optional slip-on donut or ring 60 formed of recoil abatement substances. In this instance, the ring is in the form of an air bag 61 mounted onto a supporting base 62 of polycarbonate. An attachment device in the form of hexagonal screws 63 are radially arranged around base 62. Screws 63 are attachable to divets 64 on handle 4. When greater recoil prevention is deemed necessary, ring 60 can be slipped over barrel 2 and lodged against handle 4.

Figure 8:
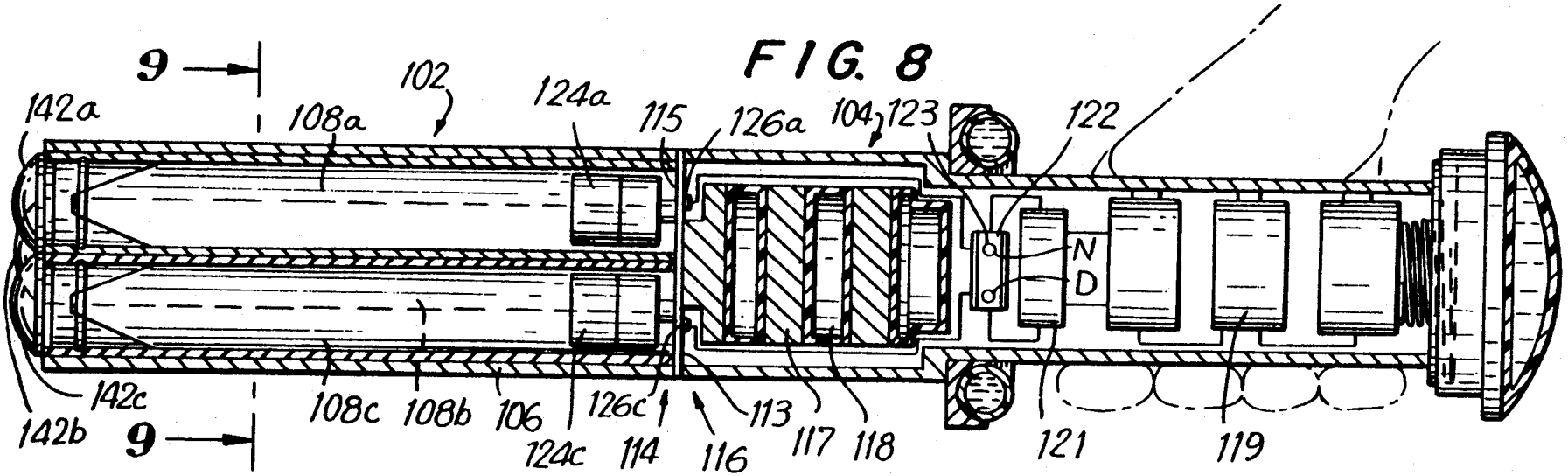
FIG. 8 is a diagramatic cross-sectional view along a length of a second embodiment of the baton gun of the invention.
Figure 9:
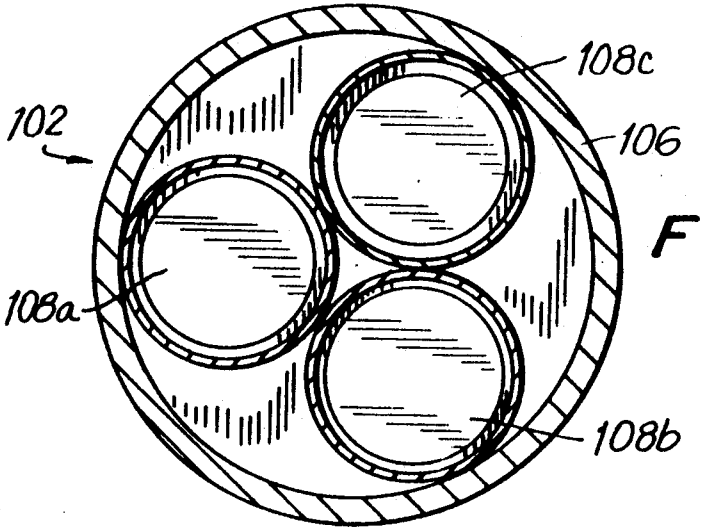
FIG. 9 is a cross-sectional view of the baton gun according to FIG. 8 taken along line 9—9.
Figure 11:
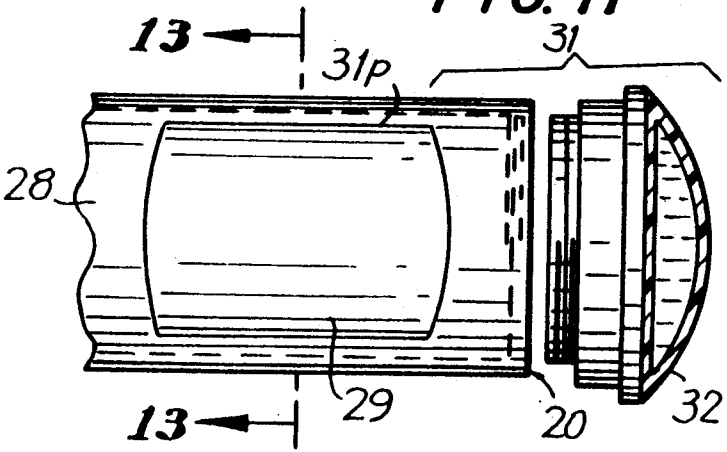
FIG. 11 is a diagramatic plan partial view of an outer palm-side portion of the handle illustrating back-side of FIG. 10, with cover unscrewed.
Figure 13:
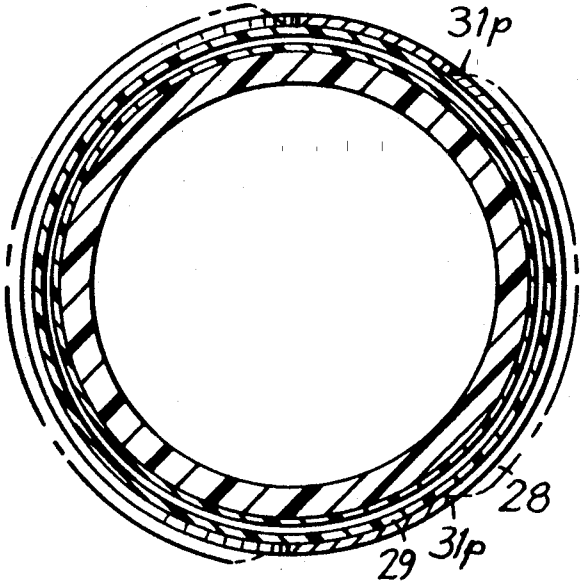
FIG. 13 is a cross-sectional view of the baton gun according to FIG. 11 taken along line 13—13.
Figure 10:
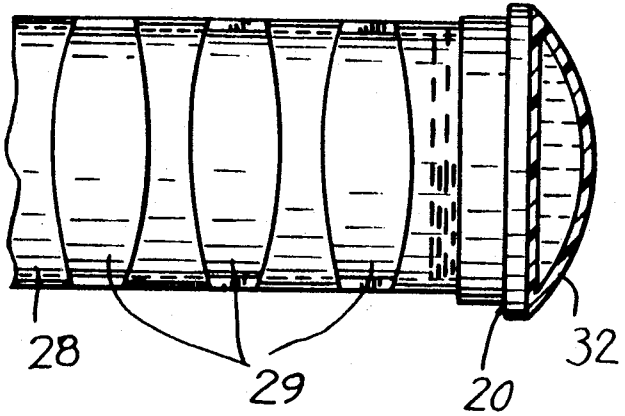
FIG. 10 is a diagramatic plan partial view of an outer finger-side portion of the handle of FIG. 1.
Figure 12:
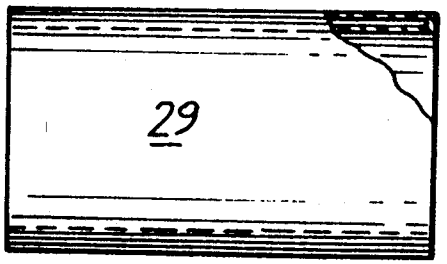
FIG. 12 is a plan view of the air sleeve surrounding the handle.

FIG. 8 illustrates a second embodiment of the invention. Barrel 102 is here provided with three separate hollow launching tubes 108*a*, 108*b*, 108*c*. Polycarbonate forms outer wall 106 of the barrel 102.

Second end 114 of barrel 102 is detachably connected to end 116 of handle 104 by means of the respective female and male couplings 115, 113.

Thereafter, beyond the increase from one to three barrels, the remaining structure of the baton gun is essentially similar to that of FIG. 2. Thus, the recoil preventative measures of a series of circular lead rings 117 and air inflated pillows 118 are here also present. Handle 104 also contains batteries 119 electrically connected to solenoid 121 which in turn electrically communicates with switch slide 122.

A discharge button 123 is slideably positioned within switch slide 122 and radially penetrates through an outer surface of handle 104. This button normally is in position N which acts as a safety position locking the button against activation. When activation becomes necessary, button 123 is slid into position D from which it may be depressed to close a circuit with battery 119 that in turn operates solenoid 121. An electrical signal is then sent through couplings 115, 113 into respective launching tubes 108*a*, 108*b*, or 108*c*. Respective electrical terminals 126*a*, 126*b* (now shown), or 126*c* are energized to create a spark which ignites gun powder charges in respective shells 124*a*, 124*b* (not shown), or 124*c*. Detonation gives rise to an explosive shock which ejects respective projectiles 142*a*, 142*b*, or 142*c*.

Separate discharge buttons, batteries and solenoids may be provided for each of the separate projectiles.

Optionally there may also be provided the additional recoil preventative measures of air-filled sleeve 129, expansion receiving apertures 131 and donut ring 160.

The invention, of course, encompasses not only the specific structure shown and described above, but also variants and modifications which should be considered within the spirit and scope of the appended claims.

What is claimed is:

1. A projectile launching baton comprising:

a hollow barrel having a first and second end opposite one another, and said barrel possessing an outer wall being formed from an organic polymeric substance;

a projectile lodged in a mouth of said barrel at said first end thereof; and a handle disengageably connected to said second end of said barrel, said handle comprising a chamber enclosing a means for initiating discharge of said projectile and at least one means for preventing recoil.

2. The baton according to claim 1 wherein said organic polymeric substance is selected from the group consisting of plastic and rubber.

3. The baton according to claim 2 wherein said organic polymeric substance is a polycarbonate.

4. The baton according to claim 1 wherein said means for preventing recoil is a fluid-filled flexible-walled pillow.

5. The baton according to claim 4 wherein said fluid is selected from the group consisting of air, water, gels, and combinations thereof.

6. The baton according to claim 1 wherein said means for preventing recoil is horizontally positioned in said handle and selected from the group consisting of lead, felt, cork, foam, air pillow, gel pillow and combinations thereof.

7. The baton according to claim 6 wherein different ones of said means for preventing recoil are alternatingly positioned one above another in said handle.

8. The baton according to claim 1 further comprising a discharge button on said handle positioned radially and penetrating an outer surface of said handle.

9. The baton according to claim 8 wherein said button is secured within a switch slide operating as a safety latch.

10. The baton according to claim 1 wherein said barrel includes a plurality of hollow barrel tubes.

11. The baton according to claim 10 wherein each of the said hollow barrel tubes carries a projectile positioned over a respective mouth thereof at said first end.

12. The baton according to claim 1 wherein an outer surface of said handle includes a means for receiving a donut shaped means for recoil abatement.

13. The baton according to claim 12 wherein said donut shaped means is an air-filled flexible walled bag supported on a solid base.

14. The baton according to claim 1 wherein an inner wall of said barrel is formed from steel.

15. The baton according to claim 14 further comprising a cylindrical wall formed of a recoil abatement substance, said cylindrical wall radially positioned between said outer wall and said steel inner wall.

16. The baton according to claim 15 wherein said cylindrical wall is formed of lead.

17. The baton according to claim 1 further comprising a means for generating an explosive wave, said generating means being positioned within said second end of said hollow barrel.

18. The baton according to claim 17 wherein said explosive means is a blank shell.

19. The baton according to claim 17 wherein said handle includes at least one battery and at least one solenoid for triggering said explosive means.

20. The baton according to claim 1 wherein said projectile has a head and a body.

21. The baton according to claim 20 wherein said head has a greater circumference than said body.

22. The baton according to claim 20 wherein said head is formed from a rubber.

23. The baton according to claim 20 wherein said head includes a means for removeably attaching to said body.

24. The baton according to claim 20 wherein said head carries a shock spreading agent selected from the group consisting of small pellets and powdered iron.

25. The baton according to claim 20 wherein said body is at least partially hollowed.

26. The baton according to claim 20 wherein said projectile includes a means on said body for temporarily securing same against an inner wall of said hollow barrel.

27. The baton according to claim 26 wherein said securing means is at least one protrusion projecting outward from said body engageable within a recess of said inner wall of said hollow barrel.

28. The baton according to claim 26 wherein said securing means is at least one recess formed in said body engageable around a respective recess of said inner wall of said hollow barrel.

29. The baton according to claim 1 wherein said handle has walls formed from a plastic substance and further comprises a fluid-filled sleeve circumferentially surrounding said plastic wall.

30. The baton according to claim 29 wherein said fluid in said sleeve is selected from the group consisting of air, water and gel.

31. The baton according to claim 30 further comprising a rubber layer circumferentially surrounding said fluid-filled sleeve.

32. The baton according to claim 37 wherein at least one aperture is formed in said rubber layer, said aperture allowing said sleeve to expand therethrough.

33. A projectile launching baton comprising:

a hollow barrel having a first and second end opposite one another;

a projectile lodged within said barrel; and a handle connected to said second end of said barrel, said handle comprising at least one means for preventing recoil which is selected from the group consisting of lead, felt, cork, foam, air-filled pillow, gel-filled pillow and combinations thereof, and said means being formed within a hollow area of said handle.

34. A projectile launching baton comprising:

a hollow barrel having a first and second end opposite one another, and said barrel possessing an outer wall being formed from an organic polymeric substance and a wall circumferentially inward of said outer wall being formed of lead;

a projectile held within said barrel; and a handle disengageably connected to said second end of said barrel, said handle comprising a chamber enclosing means for propelling said projectile from said barrel.

* * * * *